United States Patent [19]

Alford

[11] 4,087,824

[45] May 2, 1978

[54] ASYMMETRICALLY FED ANTENNA ARRAYS

[76] Inventor: Andrew Alford, 71 Bacon St., Winchester, Mass. 01890

[21] Appl. No.: 344,422

[22] Filed: Mar. 23, 1973

[51] Int. Cl.[2] ..... H01Q 1/36; H01Q 9/16

[52] U.S. Cl. ..... 343/806; 343/908

[58] Field of Search ..... 343/806, 818, 819, 837, 343/838, 890, 891, 836, 833, 908

[56] References Cited

U.S. PATENT DOCUMENTS

| | | | |
|---|---|---|---|
| 2,759,183 | 8/1956 | Woodward, Jr. | 343/806 X |
| 3,375,525 | 3/1968 | Fisk et al. | 343/806 X |
| 3,409,893 | 11/1968 | Sivkola | 343/806 X |

*Primary Examiner*—Alfred E. Smith
*Assistant Examiner*—T. N. Grigsby

[57] ABSTRACT

A means for reducing ripple in omnidirectional radiation patterns produced by asymmetrically fed antennas arranged around a tower are disclosed. The means comprises antenna mounting panels spaced from the faces of the tower.

7 Claims, 8 Drawing Figures

ASYMMETRICALLY FED ANTENNA ARRAYS

BACKGROUND OF THE INVENTION

Improved zig-zag antennas were disclosed in U.S. Pat. No. 2,759,183. As described in this patent, a zig-zag antenna consists of a long conductor bent into sinuous or zig-zag curve and supported by insulators in a plane parallel to a flat metal sheet at distances of the order of one-tenth of a wavelength at which the antenna is to be used. The effective electrical length of a complete convolution, as measured along the conductor, is made one wavelength long. The overall length of the antenna is usually between 6 and 10 wavelengths.

There are several ways of supplying power to zig-zag antennas, among them there are two methods for feeding the antenna at the half-way point of the long conductor. These two methods may be referred to for brevity as: (a) series feed and (b) parallel feed.

The series feed is symmetrical and, therefore it results in symmetrical patterns, but it requires a balun and a transformation from a rather high impedance of the order of 500 ohms looking into the two halves of the antenna conductors in series with each other down to the 75 or 50 ohm characteristic impedance of a coaxial transmission line which is likely to be used to feed the antenna. Such baluns, together with large ratio impedance transformations, are not only expensive but also, in many cases, impose a limit of their own on the maximum power handling capacity of the antenna.

The parallel feed is accomplished by making the two halves of the antenna come together and meet each other in cusp, usually at the center of the antenna. The cusp where the two conductors meet is then connected to the inner conductor of a coaxial transmission line. The outer conductor of this transmission line is connected to the metal sheet near which the zig-zag antenna is mounted. The parallel feed requires no balun and the impedance transformation ratio is decreased by a factor of 0.25.

If one visualizes an imaginary plane that is perpendicular to the supporting sheet and which passes through the long axis of the zig-zag antenna, it is found that the portion of the zig-zag in the neighborhood of the parallel feed point is asymmetrical. When the long axis of the antenna is vertical, the effect of the asymmetry is to distort the horizontal radiation pattern of the antenna. This distortion includes a change in the direction of the maximum radiation, a change in the phase distribution with azimuth angle and a change in the shape of the pattern. These effects are particularly undesirable when one is attempting to obtain an approximately circular radiation pattern in the horizontal plane by making use of four zig-zag antennas mounted on the four faces of a square vertical metal cylinder. What is obtained is not a circular pattern with a shallow ripple, but a pattern with deep ripples of non-sinusoidal shape. The ratios of the maxima to minima in the horizontal pattern is often too large to meet specifications of the desired circularity.

Similar undesirable effects are encountered when three zig-zag antennas are used on three faces of the cylinder to obtain an approximation to a cardiodial pattern or when two zig-zags are used to obtain a radiation pattern which is intended to result in even coverage of, say, 120° of the horizon.

SUMMARY OF THE INVENTION

One embodiment of this invention provides means for improving the radiation patterns of zig-zag antennas with parallel feeds. According to this embodiment, the improved radiation patterns are obtained by mounting a zig-zag antenna parallel to and at a small distance in terms of the wavelength from a long narrow metal panel and then mounting this supporting panel at a small distance in terms of the wavelength from the metal face of the tower with the panel being supported by a continuous long metal bar centrally arranged with respect to the panel and fastened as well as electrically connected both to this panel and to the metal face of the supporting structure. It is preferable that the good electrical connections be established throughout the length of the bar between the panel and the face of the supporting structure such as, for example, a square tower.

As an aid in visualizing this embodiment of the invention, the following approximate dimensions used in a working model constructed to operate at a wavelength$\lambda$ = 5.48 inches long ($f$ = 2150 MHz) are given. The overall length of the zig-zag conductor 43.5 inches. The width of the zig-zag was 2.1 inches. The number of tilted half wave segments in the zig-zag was 20. The angle of tilt between the long axis and a half wave segment was 52.5°. The conductor was round, 0.093 inches in diameter and was spaced 0.73 inches from the panel. The panel was 3.25 inches wide and 45.2 inches long. This panel was a metal plate 0.062 inches thick and it was spaced 0.20 inches from the metal face of a square tower by a rectangular metal bar 43.5 inches long and having the cross sectional dimensions of 0.2 inches by 0.5 inches. The supporting square sheet metal cylinder on which the supporting plates were mounted had faces 6 inches wide and 48 inches high. The overall height of the supporting cylinder is not critical as long as it is as high as the supporting plate. The face width was found to have an effect on the pattern.

I find that the benefits of an antenna supporting panel spaced from another metal plate by a fraction of a wavelength extend beyond the application to zig-zag antennas (sinuous antennas) outlined above. For example, in the case of an asymmetrically fed dipole, a dipole which is particularly simple to make, more symmetrical and smoother patterns are obtained in the plane of the dipole when the dipole is mounted on a panel approximately one-half wavelength wide in the direction of the radiating elements of the dipole and this panel itself is mounted on another metal plate so that the spacing between them is a fraction of the wavelength and the panel is supported by a metal bar making electrical contact between the two plates. The length of the panel, the dimension which is perpendicular to the width is not critical, but is should preferably be over a half wavelength. When the plate to which the panel is mounted is of the same width as the panel, regular patterns are still observed and the radiation behind the spaced plates is low, particularly when the panel and the plate are long, for example a wavelength long.

OBJECTS OF THE INVENTION

Among the objects of my invention are the following: One object is to improve the regularity of the radiation patterns obtained with arrays of asymmetrically fed zig-zag antennas.

Another object of my invention is to improve regularity of radiation patterns obtained with asymmetrically fed dipoles.

Still another object of my invention is to obtain more nearly circular radiation patterns with zig-zag antennas on the four faces of a square cylinder such as, for example, a square tower.

Another object of my invention is to improve circularity of the radiation patterns of asymmetrically fed dipoles or arrays of dipoles mounted on the faces of a cylinder having three or more faces.

These and still other objects of the invention will be explained in a more detailed description of the invention in connection with the figures.

DETAILED DESCRIPTION OF PREFERRED EMBODIMENTS

Figure 1:
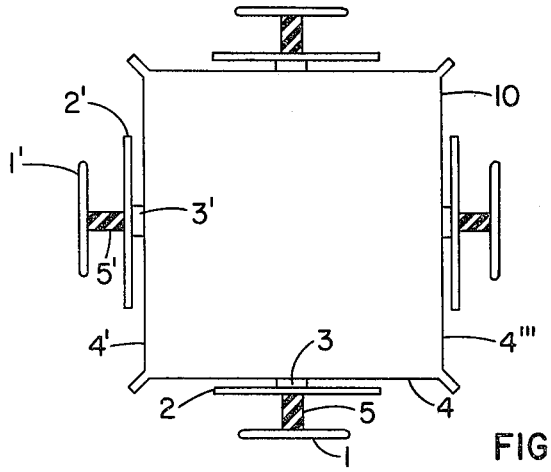
FIG. 1 shows a plan view of four zig-zag antennas mounted on a metal panel which are mounted in the proximity of the faces of the supporting square tower.
Figure 2:
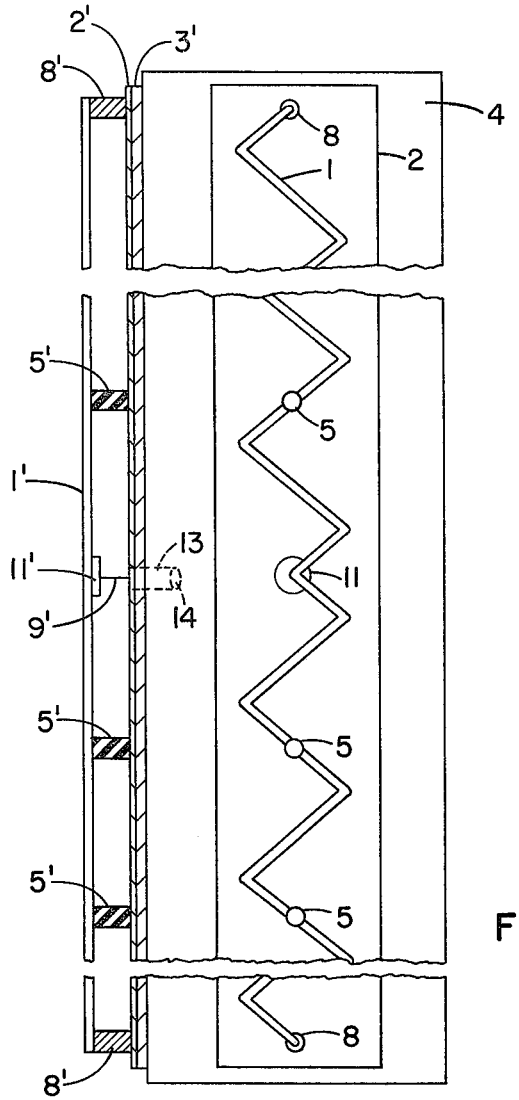
FIG. 2 shows the elevation view of the arrangement shown in FIG. 1.

In FIGS. 1 and 2, four asymmetrically fed zig-zag antennas such as 1 and 1', are arranged around a square tower 10. In accordance with the invention, sinuous conductor 1 is mounted on a metal panel 2 which is supported by metal bar 3, a small distance in terms of the wavelength from the face 4 of tower 10. Similar sinuous conductors 1', 1'', 1''' are similarly mounted on the other three faces of the square tower.

Since an ordinary square tower consists of four columns, horizontal members and diagonal bracing with a large space between these members, it is necessary to cover the face of the tower with a sufficiently fine metal screen ($0.05\lambda \times 0.05\lambda$ or finer) or with a metal sheet in order to assure proper functioning of panel 2. In some cases, it is not necessary that the screen or sheet extend the entire width of face 4 of the tower 10, but this screen should be at least as wide or wider than panel 2.

Figure 6:
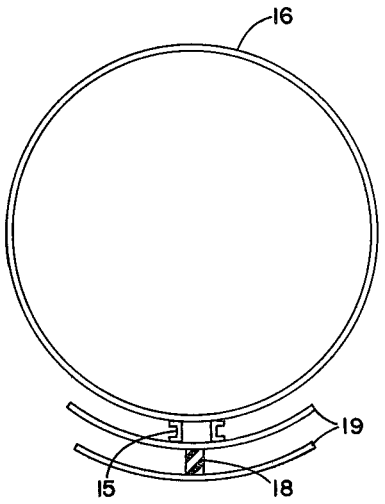
FIG. 6 shows a top view of a curved zig-zag antenna mounted at a small distance from a curved metal panel which is mounted at a small distance from a round metal tube that serves as the supporting tower.

The width W of panel 2 is preferably equal to $S + \frac{1}{2}\lambda' \pm \lambda'/10$ where S is the width of bar and $\frac{1}{2}\lambda'$ is half of the electrical wavelength in TEM made in the space between panel 2 and screen 4. Width W is not very critical so that it can be made, for example, equal to $S + 0.6\lambda'$. Width S of the bar 3 may be between $0.05\lambda'$ and $0.3\lambda'$ wide and between $0.02\lambda'$ and $0.12\lambda'$ deep. Bar 3 need not be a solid metal bar, but may be, for example, in the form of two parallel channels with space between them as shown in FIG. 6 or say, two "I" beams with some space between them. When two parallel channels or bars are used in place of a solid bar, dimension S refers to the spacing between the outside parallel surfaces of the parallel channels or bars. The spacing between the zig-zag conductor 1 and panel 2 may be between 1/15 and of the operating wavelength. Sinuous conductor 1 may be supported by stand-off insulators such as 5, 5' in FIGS. 1 and 2. The ends of the zig-zag conductor may be supported by metal bars such as 8, 8'.

It is preferable to locate panel 2 centrally with respect to the face of the tower and have the sinuous conductor located centrally with respect to panel 2.

At the midpoint, the sinuous conductor may have a cusp which is fed by the inner conductor 9 which, together with the outer conductor 13 forms a coaxial line 14 that supplies RF power to the zig-zag antenna. Metal disc 11 improves the impedance match with characteristic impedance of the coaxial feed, particularly when the portion of the inner conductor 9, 9' between disc 11' and the beginning of the coaxial line proper is made to act as a series inductance either by a helical twist or by making it of a sufficiently small diameter.

The distance L between the ends of the zig-zag conductor may, for example, be eight wavelengths long at the operating frequency. Panel 2 should preferably be longer than the sinuous conductor. For example, it may be equal to $L + 0.5\lambda$ extending approximately equal distance beyond the two ends of the sinuous conductor.

Figure 3:
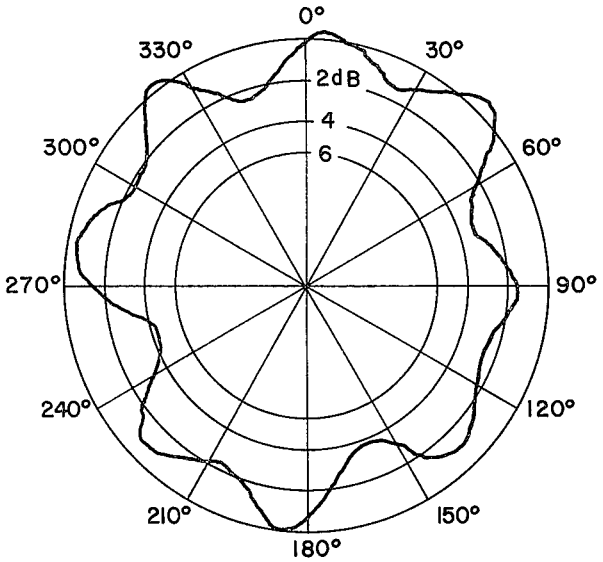
FIG. 3 shows the horizontal radiation of four zig-zag antennas arranged as shown in FIGS. 1 and 2.

FIG. 3 shows the measured horizontal radiation pattern of the arrangement of FIGS. 1 and 2 constructed in accordance with the invention. This pattern was obtained by rotating the square cylinder 10 in FIGS. 1 and 2 about its axis which was vertical. The four zig-zag antennas were fed equal amounts of RF power in the same relative phases.

Figure 4:
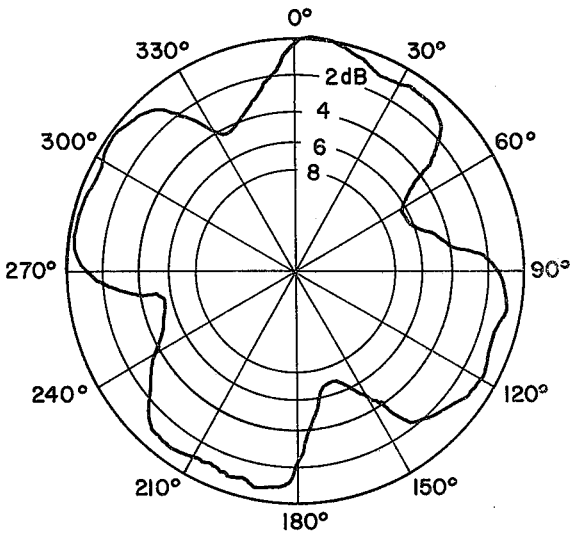
FIG. 4 shows the horizontal radiation pattern of four zig-zag antennas mounted on a square tower and arranged in the conventional way as described in the prior art.

FIG. 4 shows the measured horizontal radiation pattern with the conventional arrangement of the zig-zag antennas in which the sinuous conductors were mounted directly to the faces of the square cylinder, that is, without panel 2 and without bar 3. The spacing between the sinuous conductor 1 and the face 4 of the cylinder was the same as the spacing between the sinuous conductor 1 and panel 2 in the arrangement of FIGS. 1 and 2. In fact, the same cylinder and the same stand-off insulators were used in both cases. The four zig-zag antennas were again fed equal amounts of RF power in equal phases. It is clear from a comparison of the radiation patterns in FIGS. 3 and 4 that the radiation pattern of FIG. 3 is preferable to the radiation pattern of FIG. 4 when a good approximation to a circular pattern is desired.

Figure 5:
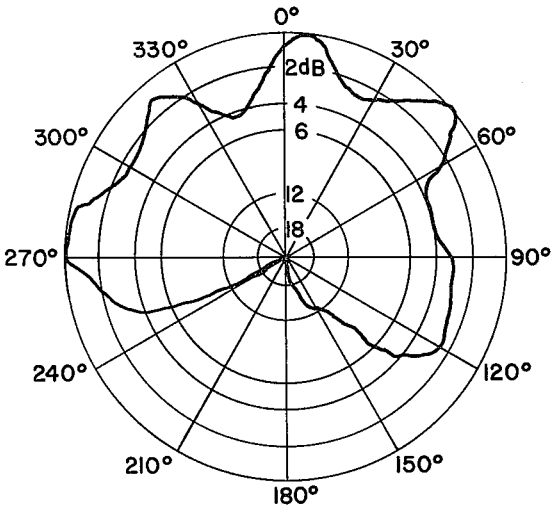
FIG. 5 shows a polar plot of the measured radiation pattern obtained with three zig-zag antennas mounted on subpanels and arranged as in FIGS. 1 and 2 in accordance with the invention.

A similar improvement over prior art is obtained when only three of the four zig-zag antennas in FIGS. 1 and 2 are fed with equal amounts of power in the same relative phases to obtain a directional pattern. The measured pattern obtained with such an arrangement is FIG. 5. This pattern also has a low ripple. When only three antennas are fed, the fourth antenna may be removed without a substantial change in the radiation patterns.

With the aid of the present invention, patterns of other shapes with low ripple can be obtained by varying the relative amounts of power and relative phases of the power delivered to the several antennas mounted around a tower.

In FIG. 6 is shown another embodiment of the invention. In this figure, the supporting tower is a large round tube 16. Several zig-zag antennas may be mounted around the tube. In this figure, sinuous conductor 17 is supported by insulators 18 at a small spacing from metal panel 19. Panel 19 is supported from the tower by two metal channels 15 which make low impedance contact with the metal tube 16 and panel 19. Both panel 19 and the sinuous conductor 17 may be curved as shown in FIG. 6. One or several such antenna arrangements may be used around the cylinder 16, the number depending on the diameter of the cylinder and on the types of radiation patterns that may be desired. The preferred dimensions of the panel 19 and the spacing between the panel and the supporting tower are similar to those described in connection with square tower provided that the diameter of the supporting circular cylinder is not too small, preferably greater than 0.8 of the operating wavelength.

Figure 7:
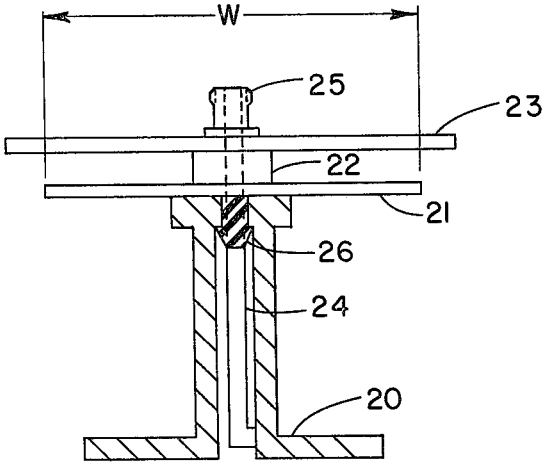
FIG. 7 shows an asymmetrically fed dipole mounted on a panel which itself is mounted on another metal plate in accordance with another embodiment of the figure.
Figure 8:
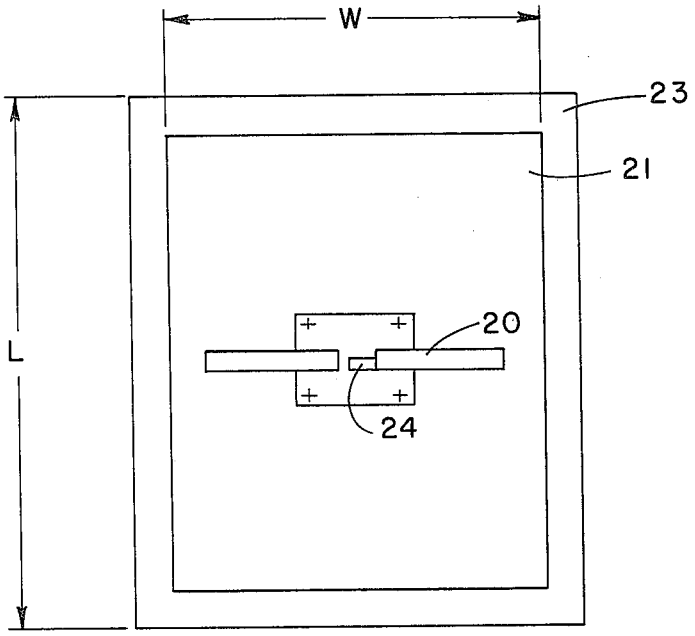
FIG. 8 shows an elevation view of the dipole in FIG. 7.

In FIG. 7 is shown an asymmetrically fed dipole 20 mounted on a metal panel 21 which is spaced by a metal bar 22 from a metal plate 23. The dipole is asymmetrically fed by the extension 24 of the inner conductor of the coaxial feeder 25. The extended inner conductor 24 is supported by insulator 26.

The width W of panel 21 is preferably equal to $S + \frac{1}{2}\lambda' \pm 0.1\lambda'$ where S is the width of bar 22 and $\lambda'$ is the wavelength in the TEM mode in the space between the panel 21 and the plate 23. Dimension X which is the separation between panel 21 and plate 23 should preferably be between $0.02\lambda'$ and $0.12\lambda'$. Where $\lambda'$ is the TEM made wavelength in the space between and panel 21 and plate 23. Reference to TEM mode wavelength is necessary because the space between panel 21 and plate 23 may in some cases be partially or fully filled with dielectric material. The width of plate 23 should preferably be equal or greater than W. The length of panel 21 is preferably of the order of one wavelength or greater.

What is claimed is:

1. A radiating means comprising an asymmetrically fed antenna, means for spacing the antenna from a metal panel by a distance 1/15 to $\frac{1}{4}$ wavelength long at the operating frequency, a feed point for the antenna intermediate the ends of said panel, centrally located conducting means extending substantially the length of the panel for spacing said panel from a metal sheet by a distance between 0.02 and 0.12 wavelengths at the operating frequency, said panel being substantially parallel to said metal sheet.

2. A radiating means in accordance with claim 1 wherein the antenna is a sinuous conductor a plurality of wavelengths long at the operating frequency.

3. A radiating means in accordance with claim 2 wherein the metal panel is between $\frac{1}{2}$ and $\frac{5}{8}$ of a wavelength wide at the operating frequency.

4. A radiating means in accordance with claim 3 wherein the panel is at least as long as the sinuous conductor.

5. A radiating means in accordance with claim 1 wherein the antenna is an asymmetrically fed dipole.

6. A radiating means in accordance with claim 1 wherein the metal sheet is a curved surface of metal cylinder.

7. A radiating means comprising an asymmetrically fed antenna, means for spacing the antenna from a metal panel by a distance 1/15 to $\frac{1}{4}$ wavelength long at the operating frequency, a feed point for the antenna intermediate the ends of the said panel, conducting means for spacing said panel from a metal sheet by a distance between 0.02 and 0.12 wavelengths at the operating frequency, said panel being substantially parallel to said metal sheet, wherein the metal sheet is a curved surface of a metal cylinder.

* * * * *